US005544499A

United States Patent [19]

Boggs

[11] Patent Number: 5,544,499

[45] Date of Patent: Aug. 13, 1996

[54] YARN ORGANIZER FOR KEEPING YARN SEPARATED WHEN HAND KNITTING

[76] Inventor: Linda W. Boggs, 5140 Woodford Dr., Centreville, Va. 22020

[21] Appl. No.: 441,632

[22] Filed: May 15, 1995

[51] Int. Cl.[6] ..... D04B 35/00; A41H 31/00; A47G 19/00; B65D 21/02

[52] U.S. Cl. ..... 66/1 A; 223/106; 223/107; 220/23.83; 220/23.4

[58] Field of Search ..... 66/1 A; 223/106, 223/107; 112/302; 220/23.83, 339, 23.4

[56] References Cited

U.S. PATENT DOCUMENTS

| | | | |
|---|---|---|---|
| 867,583 | 10/1907 | Lee | 223/106 |
| 1,283,024 | 10/1918 | Armstrong | 223/106 X |
| 2,169,297 | 8/1939 | Smith | 223/107 |
| 2,245,087 | 6/1941 | Clamtom | 223/107 |
| 2,537,940 | 1/1951 | Peake | 223/107 |
| 3,000,532 | 9/1961 | Miklich | 220/23.4 |
| 3,531,015 | 9/1970 | Makim | 220/23.4 X |
| 3,888,348 | 6/1975 | Frey | 220/23.4 X |
| 4,483,455 | 11/1984 | Prophet, Jr. et al. | 220/23.83 |
| 5,005,380 | 4/1991 | Donney | 66/1 A |
| 5,101,997 | 4/1992 | Bagwell et al. | 220/23.83 X |

*Primary Examiner*—John J. Calvert
*Attorney, Agent, or Firm*—C. Fred Rosenbaum

[57] ABSTRACT

The apparatus includes a plurality of yarn storage containers which receive skeins of different yarns which are to be interwoven to form a pattern in a knitted garment or article. The yarn containers include a removable top which contains a yarn outlet guide hole. The storage containers are mounted vertically on a horizontal base which has an upper plate that rotates and a lower plate that rests on the floor. About the periphery of the upper plate there are manually actuated turn pedals which may be operated by the foot or hand. As a garment or article is manually knitted, using different yarns in the pattern, the different yarns are twisted about each other forming unmanageable tangles as each leaves its skein due to the necessary manipulation of the yarns on the knitting needles. In use, this apparatus may be rotated manually in relation to the knitting procedure to obviate the formation of tangles in the yarns.

13 Claims, 3 Drawing Sheets

YARN ORGANIZER FOR KEEPING YARN SEPARATED WHEN HAND KNITTING

BACKGROUND OF THE INVENTION

1. Field of the Invention

In the manual knitting process, the yarn is taken out off the skein directly onto the knitting needles. One of the most important elements of manual knitting is maintaining consistency and uniformity in the stitches of the fabric. This results from the knitter manually applying a constant amount of tension to the yarns as the stitches are formed on the needles. The skein is usually placed close to the knitter, for example, either in their lap or in the chair next to them. When different yarns are to be knitted together, problems of organization of the yarns arise. The skeins of different yarns are usually placed on opposite sides of the knitter. However, when the pattern requires a change from one to the other, the knitter must twist the newly added yarn about the other yarn. This creates a twist in the yarns that extends from the knitting needles to the skein. The knitter can separate the twist immediately by changing places with the skeins. This is impractical because the newly added yarn may be used for a very few stitches and the knitter would have to discard the needles to manipulate the skeins resulting in a loss of continuity in the fabric. The knitter usually proceeds through as many changes in the yarns as possible before the yarns will not feed from the skeins to the needles because of a massive tangle of the different yarns between the needles and the skeins. The knitting must stop and the entangled yarns separated before the knitting can be resumed. It is, therefore, an object of this invention to provide a new compact, lightweight apparatus which provides positive control of the different yarns and delivers them to the needles without entanglement. The present invention relates to manual knitting of garments or articles which are constructed of different colors and/or textured yarns. The apparatus is a manually operated device that reduces the amount of time it takes to organize or untangle the different yarns during the knitting process. The device allows for an uninterrupted and orderly flow of the different yarns to the needles without the need to periodically stop the knitting and untangle the yarns. Different yarns are placed in the yarn storage containers and as the knitting proceeds with each run of stitches being cast, the apparatus is turned back and forth by hand or foot. This action of the apparatus prevents the yarns from twisting around each other and becoming entangled.

In some manual knitting procedures, such as knitting sleeve elements of a garment, separate elements are knitted simultaneously but with a different yarn to maintain the elements as separate structures. In this instance, the different yarns come from different skeins but are otherwise the same.

The device is easily portable because of its light weight and small size. It can also be used as a storage container for yarns, when not knitting or when traveling.

2. Description of the Prior Art

The use of a yarn support apparatus is shown by U.S. Pat. No. 5,005,380. The device of that patent has vertical and horizontal framework which is mounted on a support surface such as a table and clamped into place. The vertical framework supports a horizontally disposed rotating shaft that carries two yarn receptacles on opposite ends of a propeller-like device. The propeller and yarn receptacles are free to rotate as the yarn is used in the knitting process. It is evident that when the weight of the yarns in the receptacles is not equal, the heavier receptacle will rotate to the lowest point thereby adding a half-twist to the yarns.

U.S. Pat. No. 4,635,834 discloses another device which addresses the problem of entanglement of yarns during the knitting process. This device has a plurality of yarn storage compartments in a rectangular box. The yarns are fed through the end of the compartments and through orifices in a movable bar attached to the end wall of the box. The movable bar has a length approximately half the width of the box and is pivotally mounted at the centerof the box end wall. When a run of stitches is completed in the pattern, the bar is rotated from its original position through 180 degrees to a new position. Every time the knitter must release tension on the yarns to manipulate the bar a variable stitch is introduced in the pattern. It would appear from the prior art that there is need for a new and improved yarn container and organizer which permits tangle free delivery of different yarns Lo the knitting needles.

SUMMARY OF THE INVENTION

The device of this invention is preferably molded of plastic parts to provide for light weight and strong construction. The turn table base may be of two molded interlocking plates which rotate in relation to one another. The rotation may be facilitated by roller bearings molded into the contiguous surface of one of the plates or, simply, by the selection of a particular plastic which has lubricous properties. The lower plate which is to serve as the support and rest on the floor or other horizontal surface may have additional structure to increase the friction between the device and the supporting surface to create a stable platform.

The upper plate, rotatably interlocked with the lower plate, carries manually actuated pedals about the circumference which are manipulated by the user to rotate the plate and the yarn storage containers carried thereon. There are four pedals placed at 90 degrees arcs about the upper plate. The yarn storage containers may be integrally molded with the upper plate or removably attached thereto. The yarn storage containers may be separate elements in the form of tubes or elongated compartments having a closed bottom and having varying cross sectional shapes. If the containers are separate elements, the upper plate has molded at its center a spindle or center post. The center post may provide structure thereon to cooperate with the yarn storage containers to removably affix them to the post when the device is in use. The cylindrical yarn storage containers shown may have a transparent solid wall or a large gauge mesh wall. This allows visual inspection of the yarns inside the container. Each of the yarn storage containers may have a structure on the outer side wall to cooperate with the center post of the upper plate for attachment of the container to the post. Each yarn storage container has an open top and a removable cap to fit over the opening so that the yarn is enclosed inside. The cap has a yarn outlet guide hole therethrough.

A skein of yarn is placed inside the yarn storage container and threaded through the yarn outlet guide. The yarn storage container is attached to the censer post of the upper plate. Normally, there are, at least, two yarn storage containers mounted on the upper plate. The device is placed on the floor or other horizontal surface at a comfortable distance from the knitter. The placement will depend on whether the knitter will operate the device with the foot or the hand. Normally, the device is on the floor close to the foot of the knitter.

When the second yarn is to be cast into the pattern, the knitter merely rotates the device so that the second yarn is parallel to the First between the knitting needles and the yarn storage containers. In this manner, the user continuously interchanges the location of the skeins with the Foot preventing the yarns from becoming entangled while maintaining control of the stitches in the fabric by manipulating the needles in the hands. This process can go on indefinitely.

It is another object of the invention to provide a carrying case for knitting materials. The spindle or center post extends above the yarn storage containers and has a handle formed at the end thereof. Yarns, needles and other knitting paraphernalia may be placed in the yarn storage containers for transportation or safekeeping when not in use.

It is a further object of the invention to provide a device for storage of unused or partially used skeins of yarns. The separable yarn storage containers may be removed from the device and put in a designated place so that the user could make a visual check of the supply of yarns on hand. The skeins would not be susceptible to unwinding or entanglement with other stored yarns.

DESCRIPTION OF THE PREFERRED EMBODIMENTS

Figure 1:
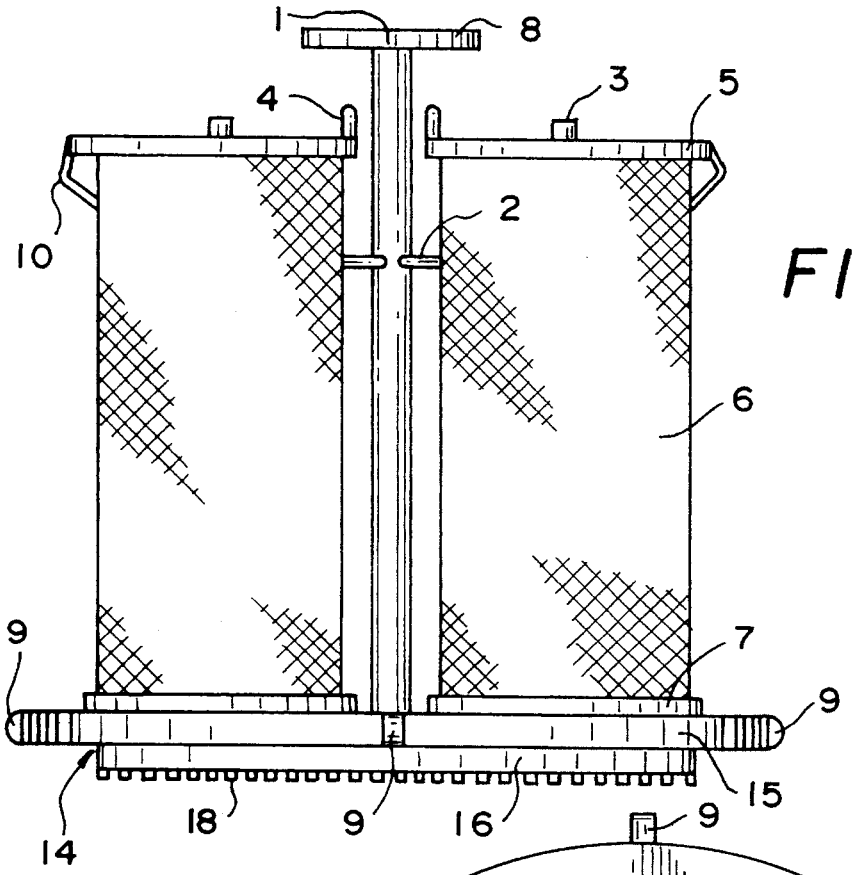
FIG. 1 is a side view of the yarn organizer.

In FIG. 1, the center post 1 extends upwardly from the center of the horizontally disposed turn-table base 14 at a right angle. The center post can be solid or hollow and may be of any cross sectional shape though circular is preferred. Center post 1 is intregally molded to the upper plate 15 of the turn table base 14. The center post 1 may be separate from but permanently fixed to the upper plate 15 by adhesives. The center post 1 can be removably attached to the upper plate 15 by cooperating screwthreads on the lower end of the center post and about the periphery of a counter sunk hole in the center of the upper plate. The free upper end of the center post is formed with a handle 8 which provides a surface by which the yarn organizer can be hand carried. The handle 8 is formed by an integral cross piece attached to the end of the center post creating a T shaped holding surface. The cross piece may be permanently or removably attached to the center post 1. The handle 8 may be formed in a conical shape so that it may be inserted into an aperture (not shown) through center post 1. Without handle 8, the user may insert fingers for carrying the device.

Figure 3:
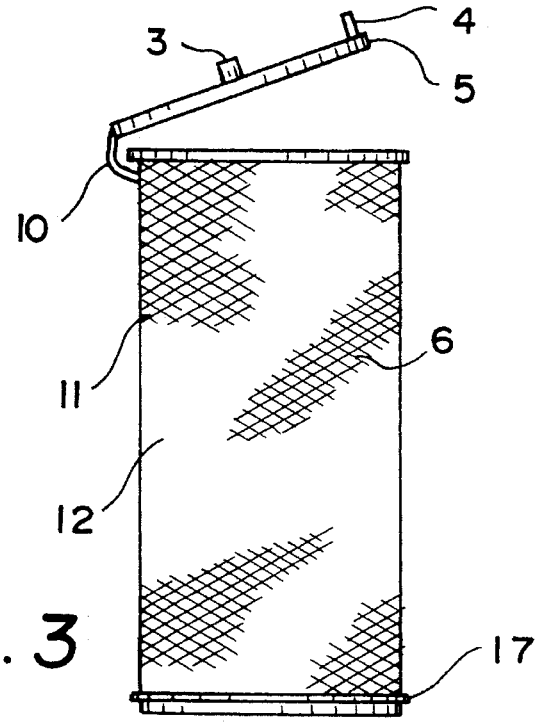
FIG. 3 is a side view of one of the yarn storage containers.

The yarn storage container 6, as shown in FIG. 3, is removably attached to the center post 1 by fastener 2. The fastener 2 may take the form of a Flexible tab formed on the yarn storage container 6. The end of the tab has a continuous (not shown) or discontinuous, C-shaped, aperture therein which is of a sufficient diameter to be fit about the center post 1. The aperture may be of any complimentary shape to match the cross section of the center post. The fastener serves to prevent the yarn storage container 6 from falling away From the center post 1 or otherwise becoming separated from the turn table base 14. It also serves to maintain the relative position of the yarn storage container on the turn table base.

The open upper end of the yarn storage container 6 is closed by a cap 5 which is friction fit over the end of the container. The cad 5 has a yarn outlet guide hole 3 formed as a central opening communicating with the interior of the container through which yarn is threaded. The diameter of the yarn outlet guide hole 3 is such that one or more strands of yarn may pass but preventing loops of yarn escaping the yarn storage containers. The cap also carries a cap lift 4 which is used to remove the cap from the yarn storage container 6 when it is necessary to refill or replace the skein inside. The cap lift 4 is a tab attached to the cap 5 and capable of being grasped by the user to apply force to the cap 5 to remove it from the yarn storage container 6. Once the skein is replaced the cap 5 is frictionally refit onto the container. To prevent the cap 5 from becoming lost or separated from the yarn storage container 6, there is a hinge 10 connecting the cap 5 to the yarn storage container 6. The hinge 10 is in the form of an enlongated flexible plastic ribbon attached at one end to the upper end of the yarn storage container 6 and the other end to the cap 5.

The yarn storage container 6 is a cylinder made of any conventional plastic material. It has an integral end wall at one end and an open end at the other.

The yarn storage container may be transparent so that the yarn inside may be viewed. A modification of the yarn storage container is shown in FIG. 3 wherein the walls are made of a mesh construction. The ribs 11 do not have to be transparent since the interior can be viewed through the mesh openings 12o The yarn storage container 6 rests on the upper plate 15 of the turn table base 14. The upper plate may have a recess 7 formed thereon. The yarn storage containers may be friction fit into the recesses to ensure their movement in concert with the upper plate 15 of the turn table base 14. A friction ring 17, as shown in Fig.3, may be formed in the lower wall of the yarn storage container. The recesses may be formed as indentations in the surface of the upper plate or a continuous wall following the cross sectional shape of the yarn storage containers may be added to the surface of the plate, as shown. The upper plate 15 has pedals 9 formed about the circumference thereof. The pedals 9 are projections extending horizontally from the periphery of the plate. The pedals 9 are placed about 90 degrees apart. The pedals 9 allow the user to move the yarn storage containers about the axis of the yarns while continuously knitting thereby preventing the different yarns from becoming entangled.

Figure 2:
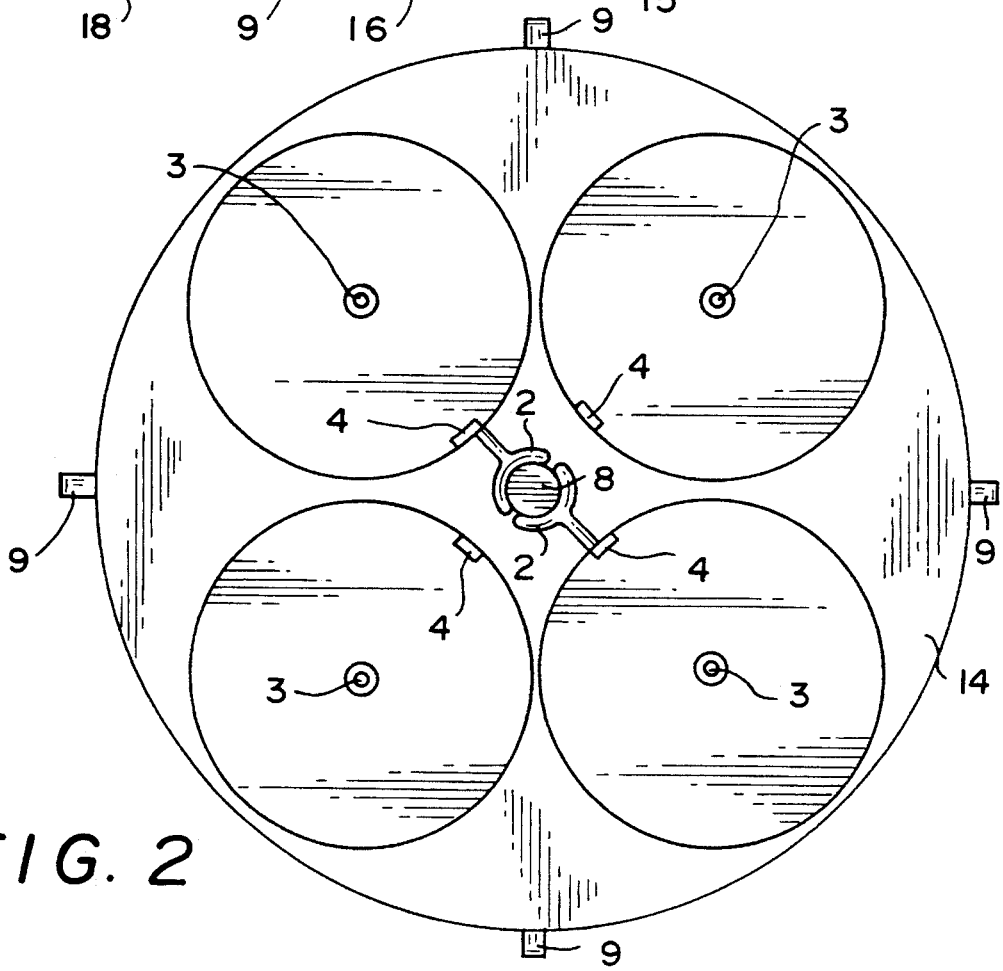
FIG. 2 is a top plan view of the apparatus.

In FIG. 2 the top plan view shows the preferred embodiment of the yarn organizer. The turn table base 14 is circular. The center post 1 extends upwardly between the yarn storage containers and is attached to them by the fasteners 2. The turn table base is such a size that it can carry four yarn storage containers 6 located at 90 degrees arcs. The pedals 9 are disposed at 90 degrees from each other on the turn table base. As shown in FIG. 2, the pedals are disposed at 45 degrees arc from the yarn storage containers. This allows the untwisting of the yarns with a minimum of effort. Looking down on the yarn organizer, as in FIG. 2, it is easy to visualize that the yarns are coming up toward the needles out of the plane of the paper. As the yarns are twisted by the knitter, the turn table rotates the skeins about the axis of the yarns so that the yarns stay parallel preventing entanglement.

Figure 5:
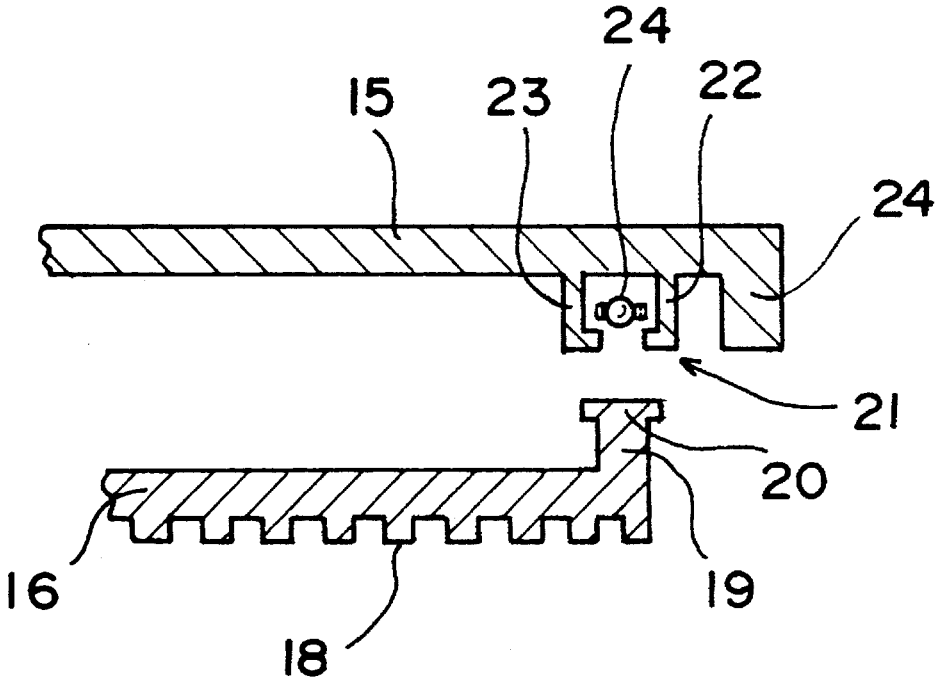
FIG. 5 is a partial cross section of the turn table base.

The turn table base 14 has two interlocked circular plates 15 and 16, as shown in FIG. 5. The interlocked plates provide the circular movement to the yarn organizer with plate 15 turning about plate 16. The upper plate 15 is a larger diameter than the lower plate 16. The periphery of lower plate 16 is formed as an upstanding rim 19 normal to the plane of the plate. The upper extremity of the rim is formed as an interlocking surface 20. The interlocking surface 20 cooperates with the retaining ring 21 which has the same diameter as rim 19 to hold the plates together. The retaining ring 21 is defined by an outer wall 22 and an inner wall 23 The depending outer wall 22 and inner wall 23 of plate 15 may merely encompass the interlocking surface 20 of plate 16. This will allow the two plates to be separated without damage because of the normal elastic properties of the plastic material. The relative rotation between the plates is free due to the slickness of the plastic material. The ease of movement of the plates may be enhanced by coating the plates with a lubricant, such as silicone. Ball bearings encased in a plastic race 24 may be included in the space between the inner wall 23 and the outer wall 22. The race may be in the shape of a ring or merely segments of a ring. The lower plate 16 has a cylindrical base portion extending below the plane of the U shaped edge of plate 15. The lower cylinder forms the supporting base of the device. The bottom surface of the base has a nonslip surface 18 embossed or otherwise affixed in the surface to provide non-slip positioning of the yarn organizer.

Figure 6:
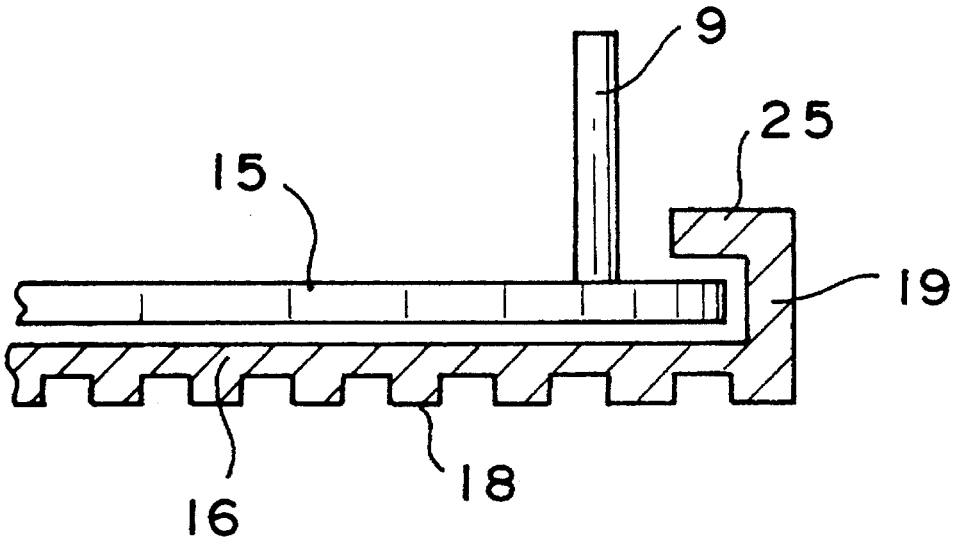
FIG. 6 is a partial cross section of a modification of the turn table base.

Another configuration of the rotating plates, shown in FIG. 6, includes the upper plate being smaller in diameter than the lower plate. The lower plate has an upstanding rim 19 about the periphery thereof forming a housing within which the upper plate fits. The upstanding rim 19 has a inwardly directed flange 25 which extends over the edge of upper plate 15. The flange 25 may be a continuous ring or it may be segmented. In this modification, the pedals 9 are formed as vertical posts parallel to the center post 1. The pedals 9 are attached to the upper plate 15 between the center post 1 and the inner edge of the inwardly directed flange 25 in such a manner as to clear the upstanding rim 19 of the lower plate.

Figure 4:
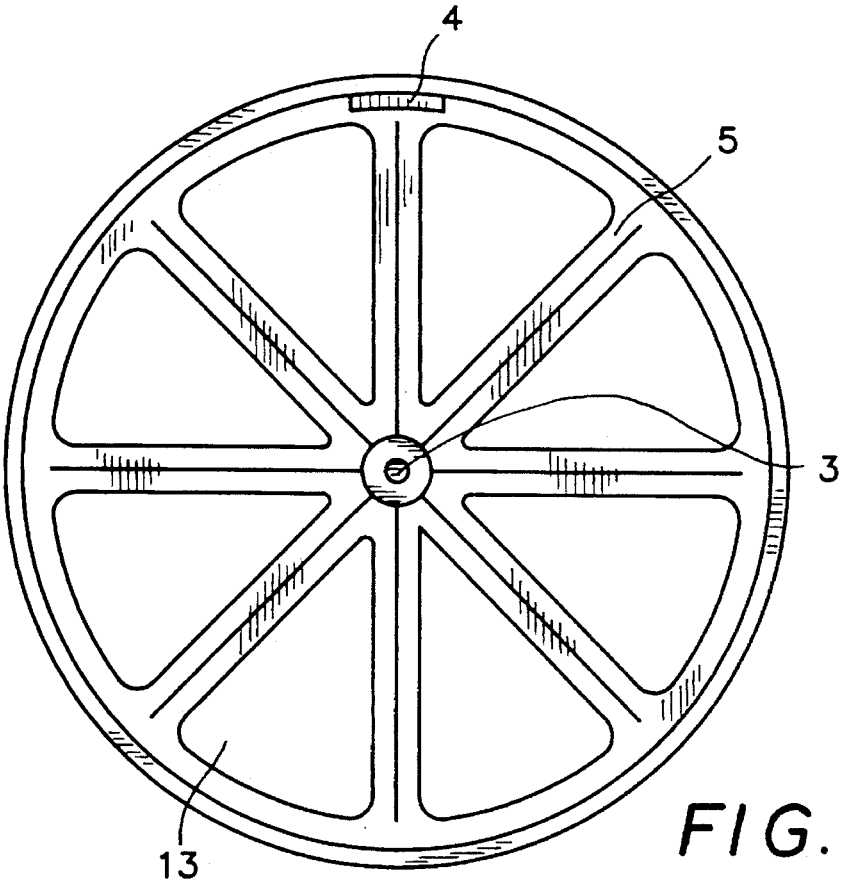
FIG. 4 is a top plan view of a modification of a yarn storage container cap.

FIG. 4 shows a modification of the of the cap 5 of the yarn storage container. In this embodiment, the cap is made as an open framework with radial ribs connecting the guide hole structure and the circumferential ring. This allows for visual inspection of the contents of the container when the device is not made of transparent material.

This device may be made out of any conventional materials used for hand operated equipment. However, the preferred materials include rubber or plastic polymers such as polyethylene, polypropylene, nylon, Teflon and polycarbonates.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A yarn organizer for simultaneously supplying different yarns during manual knitting comprising a supporting baseplate having a non-slip surface on the bottom thereof, an upper plate interlocked to and rotable with said baseplate for manual rotation of said upper plate in relation to said baseplate, at least two yarn storage container means, each of said yarn storage container means being an elongated receptacle having an open top end and a lower end, said lower end contacting said upper plate, attachment means for securing said yarn storage container means to a fixed location on said upper plate, a removable cap means closing each of said open top of each of said yarn storage container means, said cap means including a yarn outlet guide means connecting the interior of each of said yarn storage container means to the exterior, said yarn outlet guide means being of such a size to permit a single yarn to pass therethrough, whereby the rotation of said upper plate permits the parallel supply of different yarns preventing entanglement.

2. A yarn organizer of claim 1 further comprising said base plate being circular and having a first diameter, said base plate including an upstanding rim about the periphery thereof terminating in an interlocking surface, said upper plate being circular and having a second diameter larger than said first diameter, said upper plate including a depending retaining ring with a diameter the same as said first diameter, said upstanding rim of said base plate fitting into said retaining ring of said upper plate to provide relative rotation between said base plate and said upper plate.

3. A yarn organizer of claim 2 further comprising pedals formed as discrete radial extensions on the outer edge of said upper plate.

4. A yarn organizer of claim 1 further comprising said base plate being circular and having a first diameter, said base plate including an upstanding rim about the periphery thereof terminating in an inwardly directed flange, said upper plate being circular and having a second diameter smaller than said First diameter, the outer edge of said upper plate overlapping said inwardly directed flange of said base plate.

5. A yarn organizer of claim 4 wherein said pedals are formed as vertical posts on said upper plate and disposed between said center post and the inner edge of said inwardly directed flange.

6. A yarn organizer of claim 1 further comprising said yarn storage containers integrally molded to said upper plate.

7. A yarn organizer of claim 1 further comprising a center post affixed to said upper plate, said center post extending vertically from said upper plate.

8. A yarn organizer of claim 7 further comprising, said plurality of yarn storage containers removably attached to said center post.

9. A yarn organizer of claim 8 further comprising each of said yarn storage container including fastening means removably placed about said center post.

10. A yarn organizer of claim 7 further comprising a plurality of recesses on said upper plate about said center post for receiving the yarn storage containers to provide positive location of the yarn storage containers on said upper plate during rotation.

11. A yarn organizer of claim 10 further comprising said plurality of yarn storage containers frictionally engaged in said plurality of recesses.

12. A yarn organizer of claim 11 further comprising said plurality of yarn storage containers each having an integral fastening means thereon, said fastening means formed as a flexible tab having a free end, said free end containing an aperture, said aperture being engaged about said center post.

13. A yarn organizer of claim 7, including means located between said base plate and said upper plate to enhance the ease of rotational movement of said plates.

* * * * *